United States Patent [19]

Nitta

[11] Patent Number: 4,906,179

[45] Date of Patent: Mar. 6, 1990

[54] INNER COMBUSTION TYPE OF GASLIGHTER

[75] Inventor: Tomio Nitta, Yokohama, Japan

[73] Assignee: Tokai Corporation, Yokohama, Japan

[21] Appl. No.: 368,515

[22] Filed: Jun. 20, 1989

[30] Foreign Application Priority Data

Jul. 1, 1988 [JP] Japan ..... 63-86593[U]
Feb. 15, 1989 [JP] Japan ..... 1-15786[U]

[51] Int. Cl.[4] ..... F23Q 3/00

[52] U.S. Cl. ..... 431/264; 431/255; 431/266; 431/344

[58] Field of Search ..... 431/255, 264, 266, 132, 431/344

[56] References Cited

U.S. PATENT DOCUMENTS 4,150,940 4/1979 Heller et al. ..... 431/255 X
4,466,788 8/1984 Nitta ..... 431/344 X
4,478,570 10/1984 Johansson ..... 431/344
4,813,866 3/1989 Eun ..... 431/255 X
4,846,716 7/1989 Courrege ..... 431/264 X

*Primary Examiner*—Randall L. Green
*Attorney, Agent, or Firm*—Armstrong, Nikaido, Marmelstein, Kubovcik & Murray

[57] ABSTRACT

Disclosed is an improved inner combustion type of gaslighter whose inner combustion unit comprises: a mixing conduit connected to the upper end of the gas ejection nozzle; a combustion conduit integrally connected to the mixing conduit; a diffusion plate fixed in the boundary between the mixing conduit and the combustion conduit. To improve the burning efficiency by mixing the air and the combustible gas thoroughly in the combustion conduit, the diffusion plate has a plurality of apertures each having an inclined blade to cause the air drawn into the mixing conduit and the combustible gas ejected from the gas ejection nozzle to whirl in eddies.

4 Claims, 3 Drawing Sheets

INNER COMBUSTION TYPE OF GASLIGHTER

BACKGROUND OF THE INVENTION

1. Field of the Invention

The present invention relates to an inner combustion type of gaslighter which is capable of permitting supply of combustible gas at a constant rate from a gas ejection nozzle to an inner combustion space to strike a flame within the gaslighter.

2. Related Art

An inner combustion type of gaslighter which is capable of striking a flame within the gaslighter housing, has been already invented. In such a gaslighter a combustible gas is ejected from the gas well to flow into a mixing conduit at a speed which is high enough to draw air from an air inlet of the mixing conduit. The resulting air and gas mixture flows into a subsequent diffusion unit in which the air and gas mixture spreads extensively, and accordingly the flow rate of the mixture lowers. The decelerated air and gas mixture flows in a subsequent combustion conduit in which again the mixture spreads extensively to reduce its flow speed to one which is appropriate for permitting ignition in the combustion conduit (See Japanese Utility Model 63-91431 (A)).

In the conventional inner combustion type of gaslighter, however, the air and gas mixture is allowed to spread naturally in the diffusion unit. Therefore, the air and the combustible gas cannot be thoroughly mixed, and accordingly the burning efficiency remains at a relatively low value.

It is necessary to apply filters to the gas ejection nozzle and the entrance of the combustion conduit because the gas ejection nozzle and the entrance of the combustion conduit might otherwise become clogged with dust, high-viscosity liquid such as silicone or any other impurities. The use of such filters involves an increase in the number of parts.

In an attempt to reduce these problems the inventor proposed an improved inner combustion type of gaslighter (See Japanese Utility Model 63-86593 (A)). In this gaslighter, however, the width of the flame is limited by the diameter of the combustion conduit, thereby preventing expansion of the flame beyond the flame aperture. The length of the flame extending beyond the gaslighter housing is relatively short. The resulting narrow short flame is likely to hinder the uniform lighting of the end of a cigarette.

SUMMARY OF THE INVENTION

In view of the above, one object of the present invention is to provide an inner combustion type of gaslighter which is capable of thoroughly mixing air and combustible gas, thereby improving the burning efficiency of the gaslighter.

Another object of the present invention is to provide an inner combustion type of gaslighter which permits the uniform lighting of the end of a cigarette.

According to the present invention these objects can be attained by causing air and combustion gas to whirl in eddies in the combustion space of an inner combustion gaslighter, thereby expediting the mixing of these gases prior to ignition.

An inner combustion type of gaslighter which can be improved according to the present invention comprises a housing having a gas well; a plug hermetically fitted in the upper opening of said gas well, said plug having a concave space and an aperture made in the bottom of said concave space to communicate with said gas well; a valve unit having a gas ejection nozzle downwardly spring-biased;, said valve unit being fitted in said concave space of said plug; a filter placed below said valve unit to permit supply of combustible gas at a given constant rate in response to the opening of said valve; and an inner combustion unit connected to said gas ejection nozzle. Such an inner combustion type of gaslighter is improved in that said inner combustion unit comprises; a mixing conduit having a radial airinlet, said mixing conduit being connected to the upper end of said gas ejection nozzle; a combustion conduit integrally connected to said mixing conduit; an electric discharge terminal fixed to said combustion conduit via an insulator; a diffusion plate fixed in the boundary between said mixing conduit and said combustion conduit, said diffusion plate hving a plurality of aapertures each having an inclined blade to cause the air drawn into said mixing conduit and the combustible gas ejected from said gas ejection nozzle to convolute together, thus being thoroughly mixed in said combustion conduit; and a net-like object placed on the upper surface of said diffusion plate.

When in use, the liquefied petroleum gas is vaporized on the surface of the gas well, and the combustible gas flows through the aperture in the bottom of the concave space of the plug when the valve is opened. Then, the combustible gas passes through the filter, thereby allowing the combustible gas to flow at a predetermined rate, and also, preventing debris or impurities from entering the valve and the nozzle. When the gas ejection nozzle ejects the combustible gas, air is drawn from the air inlet of the mixing conduit to be mixed with the combustion gas. When the air and combustible gas mixture pass through the apertures of the diffusion plate, the inclined blades of the apertures cause the air and the combustible gas to whirl in eddies. Thus, the air and combustible gas are thoroughly mixed in the combustion space of the gaslighter.

According to one embodiment of the present invention the inner combustion unit further comprises a nozzle plate having an aperture at its center. The nozzle plate is hermetically applied to the opening of the ejection nozzle. Such a nozzle plate has the effect of increasing the flow speed of the combustible gas, thereby increasing the rate at which air is drawn into the mixing conduit.

According to another embodiment of the present invention the inner combustion unit further comprises a burner cover fixed to the flame outlet of the combustion conduit to radially expand the resulting flame. Thus, the even lighting of the end of a cigarette is assured. The burner cover may be an annular heat-resistant metal having a plurality of sector openings.

Other objects and advantages of the present invention will be understood from the following description of an inner combustion gaslighter according to a preferred embodiment of the present invention, which is shown in the accompanying drawings.

PREFERRED EMBODIMENT OF THE INVENTION

Figure 1:
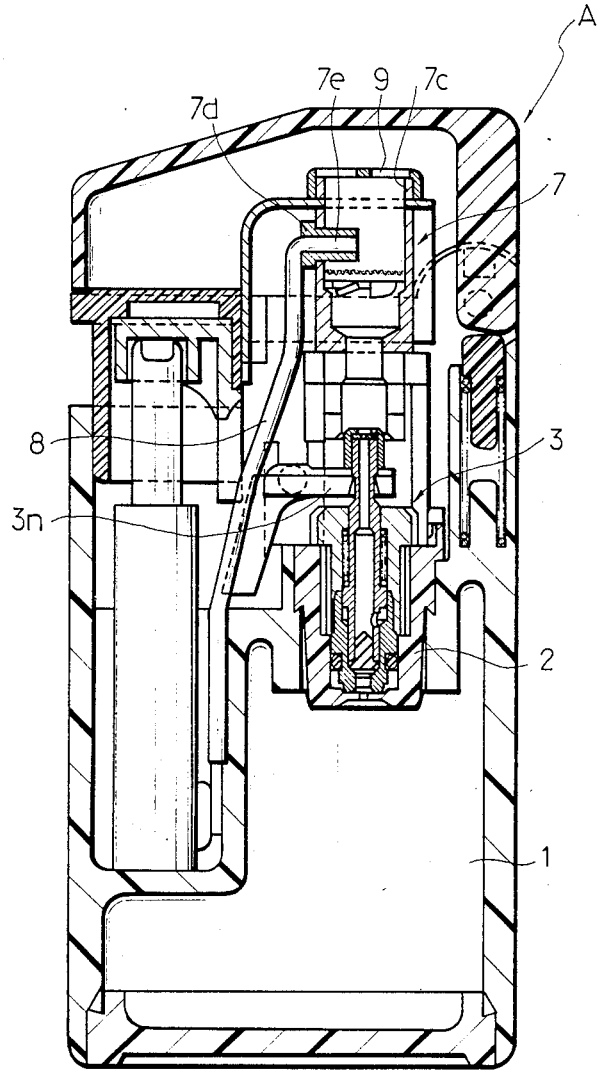
FIG. 1 is a longitudinal section of the inner combustion type of gaslighter.
Figure 2:
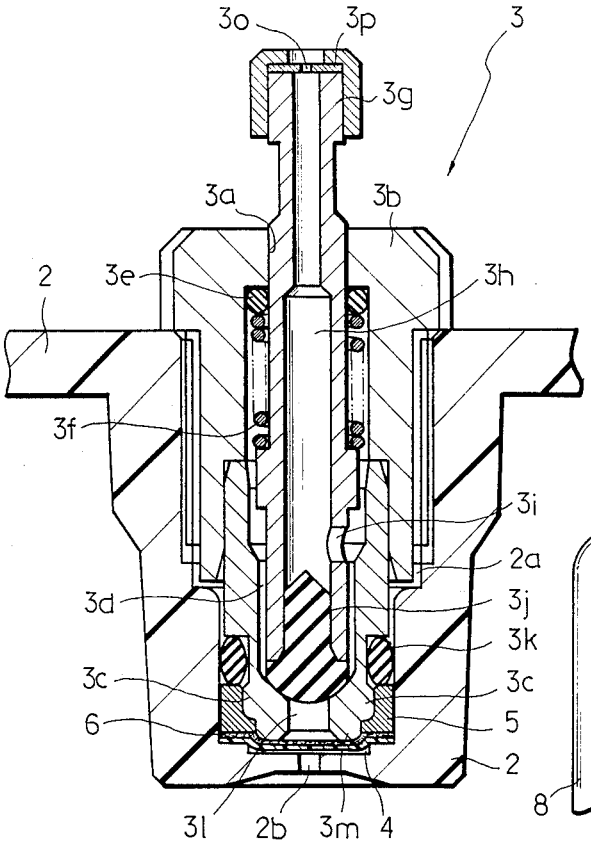
FIG. 2 is an enlarged longitudinal section of the valve unit of the inner combustion type of gaslighter.

Referring to FIG. 1, an inner combustion type of gaslighter according to a preferred embodiment of the present invention is indicated at A. As shown, a housing has a liquefied petroleum gas well 1. The upper opening of the gas well 1 is hermetically closed by integrally connecting a plug 2 to the housing by, for instance, ultrasonic welding. The plug 2 has a concave space 2*a* and an aperture 2*b* made in the bottom of the concave space to communicate with the gas well 1. The valve unit 3 is threadedly inserted in the concave space 2*a* of the plug 2. As shown in FIG. 2, the valve unit 3 includes a nozzle body 3*b* and a nozzle plug 3*c*. These are combined together to form a valve chamber 3*d*. A gas ejection nozzle 3*g* is placed in the valve chamber, and is downwardly biased by a spring 3*f* and a spiral O-ring 3*e*. The upper part of the gas ejection nozzle 3*g* passes through the aperture 3*a* of the valve body 3*b* to extend beyond the top of the valve body 3*b*. The valve unit is fitted on the concave space 2*a* of the plug 2 by screwing the valve body 3*b* into the plug 2.

The gas ejection nozzle 3*g* has a longitudinal channel 3*h* and a lateral channel 3*i* communicating with the longitudinal channel 3*h*. Also, the gas ejection nozzle has a rubber stop 3*j* hermetically fitted in the opening end of the longitudinal channel 3*h*. The rubber stop 3*j* sits on the valve seat of the hollow nozzle plug 3*c* to close the valve aperture 31. The rise of the gas ejection nozzle 3*g* will cause the rubber stop 3*j* to leave and open the valve aperture 31, thereby permitting the ejection of the combustible gas into the valve chamber 3*h*. The nozzle plug 3*c* has an O-ring 3*k* fitted in the circumferential slot (not shown) of the lower end of the nozzle plug. The O-ring 3*k* sits on an annular spacer 5, which is later described.

As shown in FIG. 2, a membrane filter 4 is placed across the aperture 2*b* of the plug 2, thereby permitting combustible gas to pass to the valve chamber at a predetermined rate. This membrane filter 4 is of a synthetic resin, and is fixed to the annular spacer 5 by thermo-compression bonding, ultrasonic bonding or impulse bonding. The annular spacer 5 with membrane filter 4 fixed on its lower side, is push-fitted into the concave space 2*a* of the plug 2. The membrane filter 4 has a piece of unwoven cloth (polypropylene) 6 laminated thereon, which unwoven cloth is 75 microns thick. This unwoven cloth 6 will keep the combustible gas supplied at a predetermined rate, and at the same time will stabilize the flame regardless of the variation of gas pressure. One example of the membrane filter material is a microporous film of polypropylene (maximum aperture size: 0.4×0.04 microns/porosity: 45%/thickness: 25 microns).

As best seen from FIG. 2, the bottom end 3*m* of the nozzle plug 3*c* is inserted in the annular spacer 5 until it sits on the unwoven cloth 6 of the filter 4. Then, the O-ring 3*k* is pushed against the upper side of the annular spacer 5 and the inner wall of the concave space 2*a* of the plug 2, thereby preventing the side leakage of combustible gas.

The free end of an operating lever 3*n* is rotatably fixed to the neck of the gas ejection nozzle 3*g* extending above the valve body 3*b*. The swing of the operating lever 3*n* about its pivot will pull up the gas ejection nozzle 3*g* until its rubber stop 3*j* leaves the valve seat of the nozzle plug 3*c*, thereby permitting the ejection of combustible gas from the apertures 2*b* and 3*l*.

Also, the gas ejection nozzle 3*g* has a nozzle plate 3*p* at its ejection end. The nozzle plate 3*p* has an aperture 30 at its center. An inner combustion unit 7 is placed to communicate with the gas ejection nozzle 3*g*.

Figure 3:
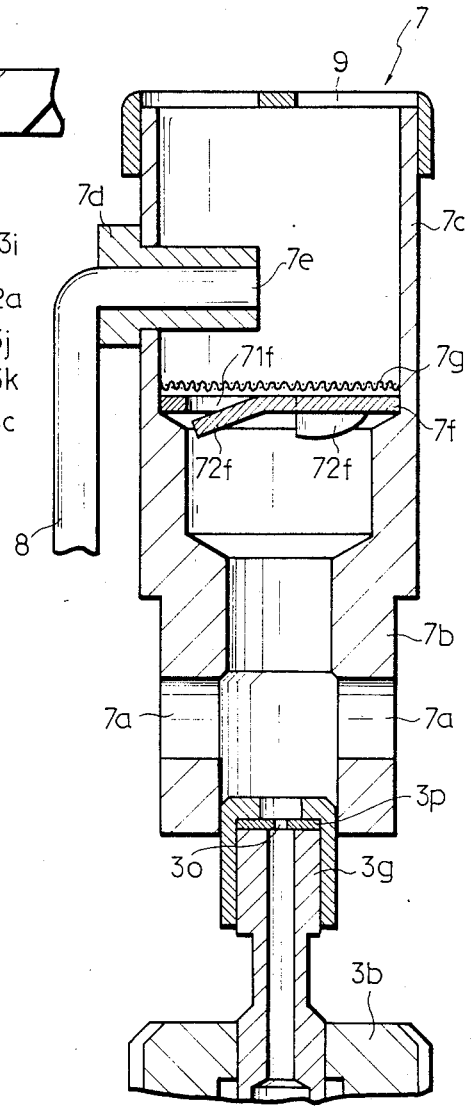
FIG. 3 is an enlarged longitudinal section of the inner combustion unit of the gaslighter.
Figure 4:
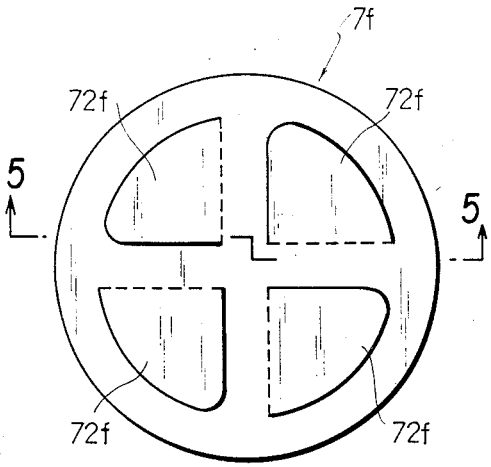
FIG. 4 is an enlarged plane view of the diffusion plate of the gaslighter.

As shown in FIG. 3, the inner combustion unit 7 comprises a mixing conduit 7*b*, a combustion conduit 7*c*, a diffusion plate 7*f* and a net-like object 7*g*. The mixing conduit 7*b* has a radial air-inlet 7*a*, and is connected to the upper end of the gas ejection nozzle 3*g*. The combustion conduit 7*c* has an electric discharge terminal 7*e* fixed to the inside of the conduit wall via an insulator 7*d*. The electric discharge terminal 7*e* is connected to one (positive) terminal of the piezoelectric element via a conductor 8. The diffusion plate 7*f* is placed in the boundary area between the mixing conduit 7*b* and the combustion conduit 7*c*. A wire net 7*g* is placed on the upper surface of the diffusion plate 7*f*.

Figure 5:
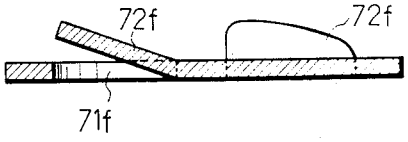
FIG. 5 is a longitudinal section of the diffusion plate taken along the line V—V of FIG. 4.
Figure 6:
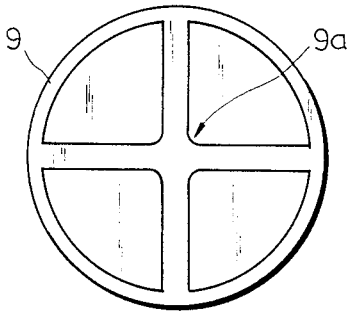
FIG. 6 is a plane view of the burner cover of the gaslighter.
Figure 7:
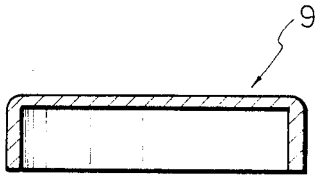
FIG. 7 is a longitudinal section of the burner cover.

As shown in FIG. 5, the diffusion plate 7*f* has a plurality of apertures 71*f* each having an inclined blade 72*f*. As shown in FIG. 3, an annular burner cover 9 is attached to the flame aperture of the combustion conduit 7*c*. This burner cover 9 is of a heat-resistant, nickel-plated metal. As shown in FIG. 6, it has a crisscross beam 9*a* to provide four sector openings. Thus, when the flame extends from the combustion conduit 7, the flame will be expanded radially in all directions. The burner cover may have apertures of shape and number which are different from FIG. 6.

When in use, the liquefied petroleum gas is vaporized on the surface of the gas well, and the combustible gas flows through the aperture 2*b* in the bottom of the concave space 2*a* of the plug 2 when the valve is opened. Then, the combustible gas passes through the filter 4 and the unwoven cloth 6. After passing through the filter 4 and the unwoven cloth 6, the combustible gas passes through the aperture 31 and then through the gap between the rubber stop 3*j* and the inner bottom surface of the nozzle plug 3*c* to enter the valve chamber 3*d*. The combustible gas flows in the lateral channel 3*i* and the longitudinal channel 3*h*, and finally it flows out of the ejection nozzle end. When the gas ejection nozzle ejects the combustible gas, air is drawn from the air inlet 7*a* of the mixing conduit 7*b* to be mixed wit the combustible gas. The throttle 3*o* of the gas ejection nozzle end has the effect of increasing the flow speed of the combustible gas, thereby increasing the rate at which air is drawn into the mixing conduit 7*b*. When the air and combustible gas mixture pass through the apertures of the diffusion plate 7*f*, the inclined blades 72*f* of the apertures cause the air and the combustible gas to whirl in eddies. Thus, the air and combustible gas are thoroughly mixed in the combustion space of the gaslighter.

The electric discharge terminal 7*e* ignites the air and combustible gas mixture in the combustion conduit 7*c*. The burner cover 9 expands the resulting flame radially in all direction, thereby permitting the uniform lighting of the end of a cigarette.

A variety of modifications can be made without departing the spirit of the present invention. For instance, the diffusion plate *7f* can be rotatably fixed in the mixing conduit *7b*, thereby permitting the rotation of the diffusion plate when the air and combustion gas passes through the apertures of the diffusion plate to expedite the mixing of air and combustible gas, and hence improve the burning efficiency.

I claim:

1. A inner combustion type of gaslighter comprising:

a housing having a gas well;

a plug hermetically fitted in the upper opening of said gas well, said plug having a concave space and an aperture made in the bottom of said concave space to communicate with said gas well;

a valve unit having a gas ejection nozzle downwardly spring-biased, said valve unit being fitted in said concave space of said plug;

a filter placed below said valve unit to permit supply of combustible gas at a given constant rate in response to the opening of said valve; and an inner combustion unit connected to said gas ejection nozzle characterized in that:

said inner combustion unit comprises:

a mixing conduit having a radial air-inlet, said mixing conduit being connected to the upper end of said gas ejection nozzle; a combustion conduit integrally connected to said mixing conduit;

an electric discharge terminal fixed to said combustion conduit via an insulator;

a diffusion plate fixed in the boundary between said mixing conduit and said combustion conduit, said diffusion plate having a plurality of apertures each having an inclined blade to cause the air drawn into said mixing conduit and the combustible gas ejected form said gas ejection nozzle to convolute together, thus being thoroughly mixed in said combustion conduit; and a net-like object lying on the upper surface of said diffusion plate.

2. An inner combustion type of gaslighter claimed in claim 1 wherein said inner combustion unit further comprises a nozzle plate having an aperture at its center, said nozzle plate hermetically applied to the opening of said ejection nozzle.

3. An inner combustion type of gaslighter claimed in claim 2 wherein said inner combustion unit further comprises a burner cover fixed to the flame outlet of said combustion conduit to radially expand the resulting flame.

4. An inner combustion type of gaslighter claimed in claim 3 wherein said burner cover is an annular heat-resistant metal having a plurality of sector openings.

* * * * *